United States Patent [19]

Lupoli

[11] Patent Number: 4,537,049

[45] Date of Patent: Aug. 27, 1985

[54] CONTROL CIRCUIT FOR LOCKING MECHANISM OF VEHICLE DOOR

[75] Inventor: Peter J. Lupoli, Hamden, Conn.

[73] Assignee: Sun Chemical Corporation, New York, N.Y.

[21] Appl. No.: 477,319

[22] Filed: Mar. 21, 1983

[51] Int. Cl.[3] ..... E05B 47/00

[52] U.S. Cl. ..... 70/277; 70/278; 70/95; 70/264

[58] Field of Search ..... 70/95, 99, 100, 264, 70/268, 270, 271, 273, 280, 262, 257, 279, 281, 275, 277

[56] References Cited

U.S. PATENT DOCUMENTS

| | | | |
|---|---|---|---|
| 1,816,504 | 7/1931 | Ulrich | 70/262 |
| 3,097,327 | 7/1963 | Bloor et al. | 70/271 X |
| 3,392,559 | 7/1968 | Hedin et al. | 70/277 |
| 3,593,816 | 7/1971 | Kazaoka | 70/264 X |
| 3,695,381 | 10/1972 | Okada et al. | 70/264 X |
| 3,765,502 | 10/1973 | Mark | 70/264 X |
| 4,286,305 | 8/1981 | Pilat et al. | 70/279 X |

FOREIGN PATENT DOCUMENTS

| | | | |
|---|---|---|---|
| 1401281 | 7/1975 | United Kingdom | 70/277 |

*Primary Examiner*—Gary L. Smith
*Assistant Examiner*—Thomas J. Dubnicka
*Attorney, Agent, or Firm*—Mitchell D. Bittman; Cynthia Berlow

[57] ABSTRACT

A power door lock control for vehicles includes a manually operable member which may be the conventional lock-unlock button. One door contains an electrically powered mechanism which operates a locking bolt. Connected to the mechanism is a contact which is cooperable with a second contact on the vehicle body when the door is closed. A pulse circuit in the vehicle is actuated when the driver presses the lock button toward its "locking" position, and supplies spaced pulses to the body contact. The pulses continue at a very low duty cycle, so as to draw minimal current, until the door is closed at which time the door contact and body contact engage one another, thereby completing a circuit from the pulse generator to the powered mechanism. This in turn operates the locking bolt to secure the door. At the same time, a current sensing circuit in the vehicle detects that a pulse of current has flowed through the powered mechanism. Once the pulse of current is sensed, the pulsing circuit is completely shut off, drawing virtually no additional power. With this device the driver, in leaving, can operate the "lock" button, and at any later time merely close the door. This latter will then be automatically locked by the pulse generator, which will then be disabled, all automatically and with minimal use of power.

25 Claims, 1 Drawing Figure

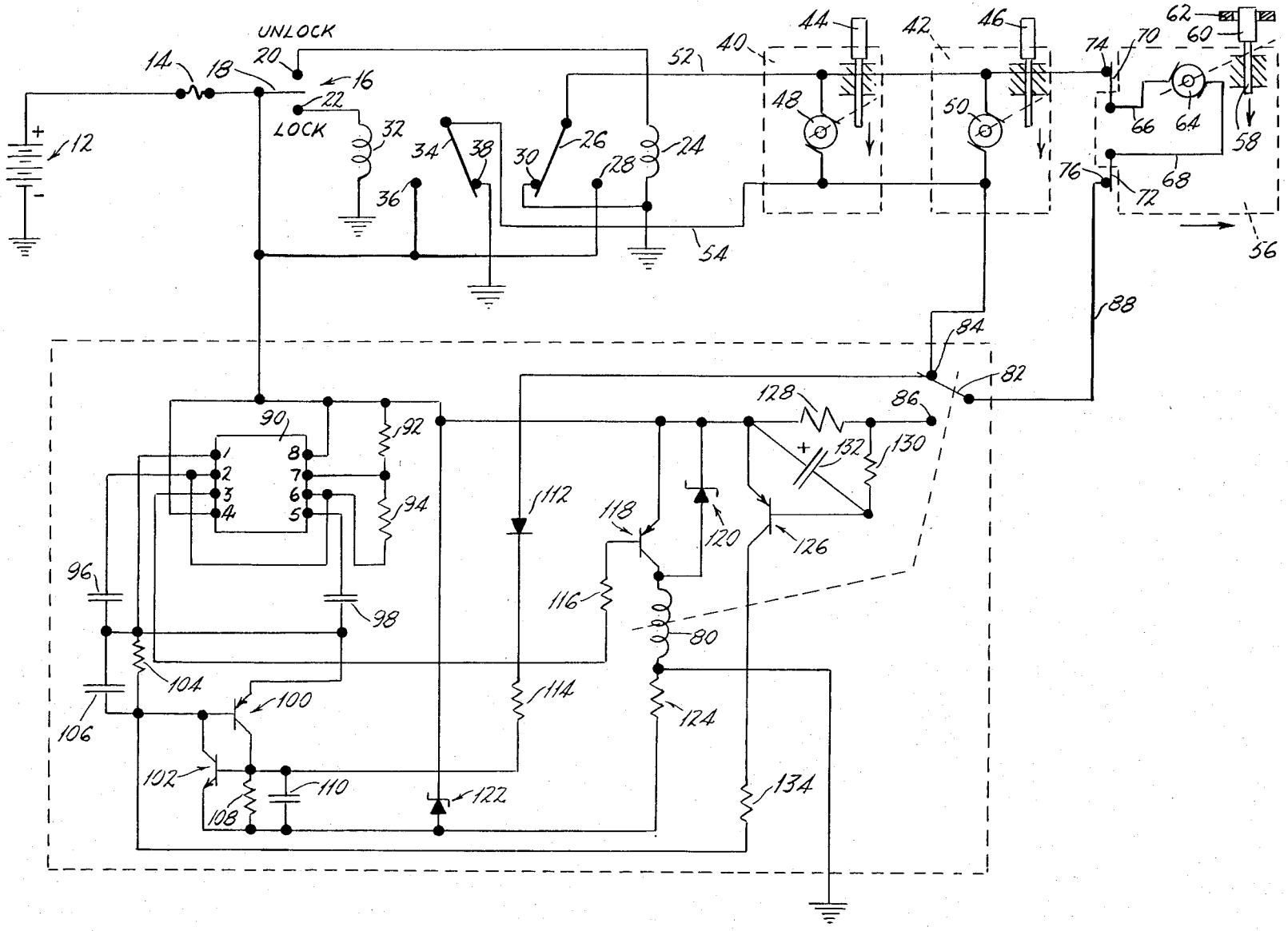
UNLOCK
LOCK

CONTROL CIRCUIT FOR LOCKING MECHANISM OF VEHICLE DOOR

This invention relates generally to automobile door locks, and more particularly to power-operated locks of the type currently being employed in many recent model vehicles.

A number of different arrangements have been proposed and developed in the past few years, which enable the driver of a vehicle to automatically lock all of the passenger compartment doors electrically by means of a switch located in a convenient area, this being possible either during driving or else exiting or entering the vehicle.

One proposal involved an automatic lock system wherein when one of the push-pull door lock buttons was operated, the others automatically followed in unison, regardless of whether the initial operation was a locking or unlocking operation.

Another more prevalent arrangement was to employ a manually-engageable rocker switch having an operator member spring biased to a central or off position, wherein it could be swiveled in either of opposite directions against the spring bias to lock or unlock all the doors of the passenger compartment simultaneously. In some of the luxury model cars, two or more such rocker switches were employed, these being typically mounted in the arm rests of the two front doors of the vehicle, or at other convenient locations as on the dashboard.

Van-type vehicles have become popular recently, these usually employing a sliding door in the side panel of the van, mounted in such a way that it can be initially urged inwardly, and thereafter shifted edgewise in order to provide access to the interior of the compartment. Such vans are generally employed by tradesman, construction workers, handymen, etc., for carrying various pieces of equipment or tools and the like.

In the past, these sliding doors were locked by hand, which represented somewhat of a nuisance since in the new model vans, very often the driver compartment doors were lockable by means of the automatic electric door lock mechanisms mentioned above.

Proposals have been made to incorporate automatic locks for the sliding doors, but due to their awkward nature and the peculiar mountings involved, namely one which enables the door to slide forwardly and rearwardly, and also retract into the vehicle, the successful introduction of such automatic operators into the field has been somewhat slow. One prior design proposed placing an electric motor operator in the door itself, such that it could directly operate one or more slide bolts. The problem involved with this arrangement was that attempts to coordinate the locking mechanism of the sliding door with that for the driver compartment were defeated by the fact that it was necessary to close the sliding door first and then operate the driver compartment lock. This represented a nuisance, since once the driver compartment doors were locked, locking of the sliding door necessitated an additional step or task, namely first closing the door and then manually locking the same or alternately reactivating the driver compartment door lock button.

SUMMARY

The above disadvantages and drawbacks of prior locking arrangements for van-type vehicles are obviated by the present invention, which has for one object the provision of a novel and improved electric-powered door lock for a sliding or other type door movable between open and closed positions in a van or other vehicle, which is at one and the same time simple in its construction while being virtually completely foolproof in its operation.

A related and important object of the invention is to provide an improved electric-powered door lock as above set forth, wherein the power drawn by the device is extremely low, thereby not causing any substantial drain on the battery associated with the vehicle electrical system.

Still another object of the invention is to provide an improved electric-powered door lock as above characterized wherein driver compartment door can be locked first, even while another door is open, and at any time thereafter the other door can be closed and automatically locked without further operations being required on the part of the driver.

Yet another object of the invention is to provide an improved electric-powered door lock of the kind indicated, which will automatically lock itself upon closing, regardless of how much time has elapsed since the driver initially locked a different door, and will thereafter automatically disconnect itself until the vehicle is at a later time unlocked again, thereby eliminating all current drain from the vehicle electrical system following such locking.

A still further object of the invention is to provide an improved door-lock mechanism as above set forth, wherein some of the electrically powered components that effect the locking of the other door can be incorporated in the door panel itself, so as to simplify manufacture and installation of the unit.

Yet another object of the invention is to provide an improved door-lock mechanism as above for a van or vehicle of the type having multiple doors, wherein the driver can effect locking of all of the doors by operation of a single control and wherein the one door can be locked immediately if desired, and the locking mechanism for a second door activated either simultaneously therewith or at any time thereafter, regardless of whether the second door is open or closed at the time that the control is initially operated.

The above objects are accomplished by the provision of a unique electric-powered door lock for a sliding or other type door which is movable between open and closed positions in a van or other vehicle, comprising in combination a manually operable locking member, cooperable locking means on the vehicle body and sliding door to enable the door to be locked in its closed position, and an electrically powered mechanism carried by the door for operating the locking means. There are also provided a pair of cooperable electrical contacts on the sliding door and vehicle body, adapted to engage one another when the door is in its closed position. The electrical contact means on the door is so arranged that it can transmit power to the electrically powered mechanism whenever the door is in the closed mode or position. Power means is so arranged as to apply intermittent energizing voltages to the vehicle body contact, these voltages being capable of effecting current for powering the locking mechanism and being produced in response to operation of the manually operable locking member. In addition, disabling means control the said power means and is responsive to engagement of the contacts and current flow therethrough, for rendering inactive the power means after the electrically powered mechanism has been activated to lock the sliding door.

The objects of the invention are also accomplished by an electric-powered door lock for a sliding-type van door movable between open and closed positions, comprising in combination a locking means on the vehicle body and sliding door to enable the door to be locked in its closed position, an electrically-powered mechanism carried by the sliding door for operating the locking means, and separable means for effecting electrical connections between the body of the vehicle and the electrically powered mechanism. Power means applies, through the said electrical connections, an intermittent voltage to the electrically-powered mechanism, which is capable of operating the mechanism, this occurring in response to closing of the sliding door. The power means is disabled by means of a special circuit after the electrically-powered mechanism has been activated to lock the door, thereby to discontinue the withdrawing of any additional power from the vehicle electrical system.

The above objects are also accomplished by an electric-powered door lock for automobiles which have a driver compartment door and a sliding rear door respectively equipped with an electric latch and a locking bolt, comprising in combination means including the locking bolt and including an electric-powered actuator and power line for locking the rear door in its closed position in response to energization of the power line, together with means including the electric latch and including a current-powered actuator and a second power line, for locking the driver-compartment door in response to energization of the current-powered actuator. Power means responsive to energization of the second power line provides intermittent electric voltages in the first power line, and there are means for connecting the first-mentioned power line to the electric-powered actuator when the sliding rear door is moved to its closed position, thereby to enable the intermittent voltages to produce currents for activating the powered actuator and locking the sliding door. Means are provided, responsive to the current flow in the first mentioned power line, for rendering inoperative the power means.

The above arrangements have a number of advantages which are not found in many of the devices of the prior art. First, the driver can effect locking of all of the doors of the vehicle, both passenger compartment and sliding doors, simultaneously if desired, by operation of a single control or switch. Alternately, the driver can, as he is leaving the car, employ the control to lock the passenger compartment doors even with the sliding door open, and at any time thereafter lock the sliding door by merely closing the same. No further operations involving the passenger compartment doors or the initial locking control or switch are required. The control circuit which monitors the condition of the sliding door when the latter has been left open draws only minimal current, operates at a very low duty cycle and only intermittently as in a sampling operation, so as to keep the overall drain on the vehicle battery low. Following the closing and automatic locking of the sliding door, the control circuit is automatically disabled such that the resultant current flow goes to zero. At such time as it is desired to enter the vehicle, access to the passenger compartment can be had with the conventional key, and thereafter the lock-unlock switch operated, to unlock all doors. Thus great ease of operation and convenience to the driver is realized.

Other features and advantages will hereinafter appear.

In the drawing, illustrating a preferred embodiment of the invention:

FIG. 1 is a schematic circuit diagram of the improved door-lock mechanism and control circuit of the present invention, illustrating the driver compartment doors and sliding door of the vehicle diagrammatically.

As designated in the figure, the vehicle is shown as having a conventional 12 volt storage battery 12, one side of the battery being connected to the vehicle chassis indicated by a ground symbol, and the other side extending to a fuse 14 from which other vehicle equipment or accessories (not shown) could also draw power. Connected to the fuse 14 is a manually operable locking member or control constituted as a double pole, two position rocker switch 16 having an arm 18 and contacts 20 and 22, the switch being preferably of the type where the arm 18 is spring biased to a central or "off" position, making no electrical contact with either of the contacts 20, 22. Extending from the contact 20 is a lead which is connected to the coil 24 of a relay having a blade designated 26, and having the blade position as shown when the coil is unenergized, and including contacts 28, 30. Connected to the other switch contact 22 is a second relay having a coil 32, blade 34, and contacts 36, 38. These relays function to enable battery voltages of reverse polarity to be applied to power door lock mechanisms to be described below. As illustrated, one terminal of each of the relay coils 24, 32 is grounded.

The passenger compartment, also hereinafter referred to as the driver compartment, can have two or more doors, diagrammatically indicated in the figure and designated by the numerals 40 and 42 respectively. The manual door lock actuator buttons or posts are shown at 44 and 46, respectively, being of conventional construction and enabling the doors to be locked or unlocked manually by a person occupying the seat adjacent the respective door. Disposed inside the door panels are electrically powered mechanisms in the form of electric motors 48, 50 which are linked or otherwise connected with the locking mechanisms of the doors (not shown) in order to effect electric-powered operation thereof when the respective motors are energized. As can be readily understood, with the switch 16 in the neutral position, no power is applied to either of the coils 24, 32 and no power is transmitted to either of the motors 48, 50. Both motors are seen to be connected in parallel, and in the event that the vehicle had more than two passenger compartment doors, the additional motors in the other doors would similarly be connected in parallel with the first two, such that they would all operate simultaneously upon energization of the coils 24 or 32. The motors 48, 50 are of the well-known d. c. variety, preferably having either integral circuit breakers or thermal cut-out protection built in. Upon operation they function only momentarily, that is, only long enough to actuate the door latch securely. The upper terminals of the motors in the figures are connected by a common lead 52, with the lower terminals being connected by a similar common lead 54, the latter being referred to in some of the appended claims as a second power line.

In operation, when the switch 16 is manually swiveled to the lock position, coil 32 becomes energized and the arm 34 shifts from the position shown to a position engaging the contact 36. Since the coil 24 remains unenergized, the arm 26 keeps the line 52 at ground potential, while line 54 is switched to the positive potential of the fused line, +12 volts. This energizes the motors 48 and 50 in the proper direction so as to lock the latches of the doors 40, 42. Normally the switch 16 is only momentarily held, and the locking function is accomplished almost instantaneously. Upon release of the switch, the arm 18 returns to the neutral or unenergized position.

On the other hand, if the switch 16 is swiveled to the unlock position, coil 32 remains unenergized, and coil 24 becomes energized, resulting in application of the vehicle's positive voltage to the line 52, while the line 54 remains grounded. This in turn operates the motors 48, 50 in the opposite direction, thereby unlocking the doors. The motors operate in a direction opposite to that of the first example because they have permanent-magnet fields and the polarity of the voltage applied to them has been reversed, as can be readily understood.

In the figure, the sliding door of the vehicle is indicated by the numeral 56. It is preferably of the type that is constituted of a panel which latches to the body of the vehicle and presents a flush outer surface therewith, and which when opened, can retract into the body and thereafter be slid forwardly or rearwardly to a position wherein it lies substantially completely within the confines thereof. Latching or locking of the door is accomplished by a slide bolt 58 which is reciprocatably mounted in the door, with the protruding part or head 60 of the bolt being extendable into an aperture in a bracket 62 of the body of the vehicle. Disposed within the door panel 56 is an electric powered mechanism or actuator in the form of a d. c. motor 64 having leads 66, 68 extending to a pair of electrical contacts 70, 72 disposed on the panel 56. The contacts 70, 72 are intended to engage cooperable electrical contacts 74, 76 on the vehicle body, as shown, when the door is closed. The contact 74 connects with the line 52, and the contact 76 connects to the blade 82 of a relay constituting part of a power means, and having a coil 80 and contacts 84, 86. The contact 84 is electrically connected to the line 54, as shown. The line joining the arm 82 to the contact 76 is indicated by the numeral 88, and is referred to in some of the appended claims as a power line.

In accordance with the present invention there is provided a novel power means which applies intermittent surges or pulses of voltage to the contact 76 after the switch 16 is swiveled to the "lock" position. In accomplishing the generation of the intermittent voltages there is provided an integrated circuit pulse generator 90 which can be the type known in the electronic trade as a "timer", designated by the identification "555", and manufactured by National Semiconductor, Motorola, RCA and others. This item is readily available, and its description need not be gone into, in further detail. The generator 90 is marked with terminal designations that correspond to the unit indicated above. Positive supply voltage from the fuse 14 is applied to terminals Nos. 4 and 8. The negative supply lead of the generator is terminal No. 1, which is connected to a latching circuit to be described below. The frequency of the pulses or voltages that are generated, as well as the pulse width (duty cycle) is determined by the values of the resistors 92, 94 and the capacitor 96 that are associated with the generator 90. Capacitor 98 is a by-pass capacitor.

Referring again to the figure, the generator 90 is normally not energized (draws no current) and is not supplying any pulses on its output line, terminal No. 3, since its negative supply line, terminal No. 1 is open. Connected to this latter terminal is a first transistor 100 which is a type PNP, and a second transistor 102 which is a type NPN. Together they form a latching circuit. When one transistor is triggered from an "off" or non-conducting state to an "on" or conducting state, the other is triggered to a similar state, and each transistor maintains the other in this conducting state until some outside influence turns either one or the other off. Connected across the base emitter junction of transistor 100 are a biasing resistor 104 and a filter capacitor 106, the latter preventing the transistor from momentarily turning on under the influence of transient signals or spikes. Similarly, connected across the base emitter junction of transistor 102 are a biasing resistor 108 and filter capacitor 110. The resistors 104 and 108 maintain the transistors 100, 102 respectively in an "off" state in the absence of any signals arriving from the line 54, as will be explained below.

Extending from the relay contact 84 is an isolation diode 112 and limiter resistor 114, the latter being joined to the base of the transistor 102 and being adapted to turn the latter on when the line 54 experiences high positive voltage. By the same token, negative voltage transients or spikes which might inadvertently appear on line 54 are effectively isolated from the transistor 102 by the diode 112. In the event that transistor 102 is "on", and the generator 90 functioning, any negative spike on the line 54 would tend to turn off this transistor and thus shut down the generator prematurely in the absence of the diode 112. Such a condition would be deleterious to the proper operation of the circuit, and accordingly the installation of the diode effectively prevents such occurrence.

The output from terminal 3 of the generator 90 is applied through a limiter resistor 116 to a driver transistor 118 which controls the relay 82. One side of the relay coil 80 is grounded as shown. Zener diode 120 provides protection for the transistor 118 in the event that induced voltages from the coil 80 might exceed the breakdown voltage of the collector of the transistor 118.

An additional Zener diode 122 (nominal voltage rating 16 volts) is connected between the positive supply line from the fuse 14 and a resistor 124 to ground. This prevents abnormally high voltages which might inadvertently occur in the vehicle electrical system from reaching the generator 90 and possibly causing damage thereto.

A current sensing circuit is connected to the relay contact 86, comprising a transistor 126 and resistor 128. Time delay capacitor 132 is a fairly large value electrolytic which prevents inadvertent turn-on of the transistor 126 due to transients or spikes. The resistor 130 is a biasing resistor for the transistor 126. In the collector circuit of the transistor 126 is a resistor 134 which extends to the base of the transistor 100.

In operation, the generator 90 is normally off due to the fact that the transistors 100 and 102 are non-conducting and the switch 16 is occupying its neutral position, not having been actuated. In the event that the switch is swiveled to its unlock position, the motors 48, 50 operate momentarily in order to unlock the doors 40, 42 but no voltage appears on the line 54. That is, it remains at ground potential due to the arm 34 being connected to the contact 38. It is noted that the relay blade 82 normally assumes the position shown in the figure, except for momentary excursions following a "lock" command from the switch 16, as will be explained.

If it is desired to lock the vehicle, and the sliding door 56 is closed, the switch 16 is merely swiveled to the lock position, which operates the motors 48, 50 and also the motor 64 through the contact pairs 70, 74 and 72, 76. Contacts 70, 74 are in the present case at ground potential, whereas contacts 72, 76 are at positive potential via line 54 through relay blade 82. The positive potential on the line 54 forward-biases the diode 112 through the contact 84, and through the resistor 114 the transistor 102 is turned on, which then turns on the transistor 100. Since both of these transistors are saturated, the negative supply terminal No. 1 of the generator 90 is brought down to a level near ground (resistor 124 is relatively small in value).

When the generator is initially energized, its output on terminal No. 3 is sufficiently positive for a period of 20 seconds or so, in order to maintain the transistor 118 off, and the relay 82 does not operate at all during this period. Following the elapse of the 20 second interval, the generator sends out a negative-going pulse causing the transistor 118 to turn on, energize the coil 80, and pull the blade 82 into engagement with the contact 86. Current then flows from the fused line through the resistor 128, left to right in FIG. 1, turning on the transistor 126 which pulls the base of the transistor 100 sufficiently positive to turn it off, unlatching the transistors 100 and 102 and disabling the generator 90. The entire circuit within the dotted lines in FIG. 1 now draws zero current, and will continue to do so until the vehicle is unlocked again, and switch 16 operated. If it is desired to lock the vehicle while the sliding door 56 is open, the switch 16 is swivelled to the lock position, which again operates the motors 48 and 50 as before. However, now the contact 70 is separated from the contact 74, and the contact 72 is separated from the contact 76. Under these circumstances, the positive voltage from the line 54 forward-biases the diode 112, and turns on the transistor 102, which in turn causes the transistor 100 to conduct. The two transistors latch, energizing the generator 90 through its negative supply line 1. With the sliding door still open, the generator 90, allowing an initial period of 20 seconds or so to elapse during which the voltage on the terminal 3 is positive (near +12 volts), emits a series of negative-going pulses of low duty cycle (10% or so), typically a single pulse of two seconds followed by a positive pulse of +12 volt level of 20 seconds. This signal is applied to the transistor 118 which in turn operates the relay 82 at this rate, and causes the blade 82 to engage the contact 86 for two seconds, then release for 20 seconds, continuing this process indefinitely. At any later time, should the sliding door 56 be closed, the contact pairs 70, 74 and 72, 76 will engage one another, and the next 2-second signal or surge on the line 88 will cause the motor 64 to operate, thus driving the slide bolt 58 to its locking position. At the same time, the current through the motor 64 will have flowed through the resistor 128 (typically a fraction of an ohm), causing forward biasing of the base emitter junction of transistor 126. This in turn raises the level on the base of transistor 100 sufficiently to turn it off, and turn off the transistor 102, shutting down the generator 90. At this point, no further pulses will be produced by the generator 90, the transistors 100 and 102 will both be off, the transistor 118 will remain off, as will the transistor 126, and no current will be flowing through any of the circuitry in the dotted outline. Accordingly, there will be no drain on the vehicle battery after the sliding door is closed and locked.

The above arrangement has the following advantages. Minimal drain on the battery of the vehicle electrical system occurs, since even though the lock function has been triggered with the sliding door 56 ajar, the duty cycle of the signals applied to the line 88 is very low, on the order of 10% typically, and this figure could be reduced if necessary. Accordingly, current is flowing through the relay coil 80 only 10% of the time, or less. In the circuit illustrated, this current is on the order of 70 milliamperes, and with a 10% duty cycle, the average current through the coil is about 7 milliamperes. Current drain from the generator 90 is also on the order of a few milliamperes, which is considered very low for a conventional 12-volt automotive electrical system. After the sliding door 56 is closed and the control circuit effects locking of the bolt 60, the circuit shuts itself off, so that the current draw on the electrical system drops to virtually zero, until the vehicle doors are once again opened.

There is no limitation on the time interval following initial locking of the passenger compartment doors, before which the sliding door must be closed. That is, the signals will appear on the line 88 (for operating the motor 64) indefinitely, until the sliding door is closed. Accordingly, great flexibility is realized. Due to the low current that is drawn, even with the sliding door ajar, this interval could be on the order of hours or even days, without substantially draining the vehicle battery.

The control circuit is highly immune to stray signals or transient voltages. Adequate overvoltage protection has been built into the device, in the form of the Zener diode 122 whose cathode is connected directly to the positive supply line, and whose anode connections are such that the total voltage across the generator 90 and the latch circuit comprising transistors 100 and 102 cannot exceed the Zener voltage. The Zener employed typically has a rating of 16 volts nominal, and thus the voltage across the diode is limited to a value not exceeding this.

The following is a listing of the component types or values that have been employed in an actual circuit that was constructed and tested, and have been found to provide satisfactory performance. These values are to be considered typical, and non restrictive, since it is likely that other values or component types would function in this circuit with equally good results:

Transistor 102 is type 2N3903. Transistors 100 and 118 are both type 2N3905. Diode 112 is a 1N4001, whereas the Zener diodes 122 and 120 are respectively types 1N966 (16 volts) and 1N4753 (36 volts). The resistance of coil 80 is on the order of 165 ohms. Capacitor 96 is 220 microfarads, and capacitor 98 is 0.01 microfarad. Capacitors 106 and 110 are each 10 microfarads, and resistors 104 and 108 are each 2200 ohms. Resistors 114 and 124 are each 1000 ohms, with resistor 134 being 220 ohms. Capacitor 132 is 47 microfarads, with resistor 128 being 0.28 ohms, and resistor 130 being 470 ohms. Resistor 92 is 100,000 ohms, and resistor 94 is 5600 ohms. It is assumed that the battery voltage of the vehicle cell 12 is 12 volts d. c.

Further isolation against inadvertent triggering is provided by the diode 112, which prevents the transistor 102 from being inadvertently triggered to an "off"

state, from an "on" state, by a negative-going transient on the line 54.

Finally, the Zener diode 120 protects the transistor 118 from possible damage due to induced voltages from the coil 80 when the current flowing through it is suddenly reduced to zero (that is, when the transistor 118 shuts off the current, there results a substantial induced voltage in this coil, due to the sudden collapse of the flux). As is well known, transients or spikes of one variety or another are known to exist in the electrical system of a motor vehicle, these being generated by the various d. c. motors employed with heater or air conditioner blowers, power seat operators, power windows, and a host of other electrical accessories.

The pairs of cooperable contacts 70, 74 and 72, 76 comprise the power circuit for the motor 64. The contact pair 74, 76 is connected to the supply side of the power circuit, whereas the contact pair 70, 72 is connected to the consumption side of the power circuit, having the motor 64.

From the above it can be seen that I have provided a novel and improved automatic electric-powered door lock system which is both reliable and foolproof in use, and does not require any special instruction or effort on the part of the driver, when learning to use the device. The use of solid state components contributes significantly to the reliability of the system, and accordingly the arrangement that has been disclosed represents a distinct advance and improvement in the automotive field.

According to the invention there is provided a method of locking the sliding door 56 of the automotive vehicle after the door has been first closed, said door being of the type having an electric actuator 64 which operates a lock mechanism 58, 60 and having an electrical contact 70 or 72 which, when the door is closed, is engageable with a cooperable contact 74 or 76 on the vehicle body, said method comprising the steps of manually activating an electric triggering circuit which supplies intermittent voltages and remains active as long as the door remains open, applying the voltages supplied by the triggering circuit to the vehicle body contact, sliding the door 56 to its closed position to effect engagement of the contacts 70, 74 and 72, 76 whereby the voltages on the contact of the vehicle body are transferred to the contact of the door to enable the voltages to cause operating current to flow through the electric actuator 64, and employing any resultant operating current to disable the electric triggering circuit and thereby terminate the flow of current after the door 56 has been locked by the actuator.

Each and every one of the appended claims defines an aspect of the invention which is distinct from all others, and accordingly each claim is to be treated in this manner when examined in any determination of novelty or validity.

Variations and modifications are possible without departing from the spirit of the invention.

What is claimed is:

1. An electric-powered door lock system for a door movable between open and closed positions in a van or other vehicle, comprising in combination:

(a) a manually operable locking member, (b) cooperable locking means on the vehicle body and door, to enable the latter to be locked in its closed position, (c) an electrically powered mechanism carried by said door for operating the locking means, (d) a pair of cooperable electrical contacts on said door and vehicle body respectively, adapted to engage one another only when the door is in its closed position, (e) said electrical contact on the door being adapted to transmit power to said mechanism, (f) power means for applying an intermittent voltage to said vehicle body contact, said power means being capable of operating said electrically powered mechanism and being rendered operable in response to actuation of said manually operable locking member, and (g) automatically actuated disabling means controlling said power means and responsive to engagement of said cooperable contacts, for automatically rendering inactive the power means only after said electrically powered mechanism has at least once been activated to lock the door.

2. The invention as defined in claim 1, wherein:

(a) said power means comprises a pulse generator adapted to supply a series of pulses spaced apart from one another.

3. The invention as defined in claim 1, wherein:

(a) said door is of the sliding type, (b) said locking means comprising a slide bolt on the sliding door, and (c) means on the vehicle body, providing an aperture in which the slide bolt is received when the electrically powered mechanism is actuated.

4. The invention as defined in claim 1, wherein:

(a) said manually operable locking member comprises a double pole switch having two positions, corresponding respectively to locking and unlocking conditions.

5. The invention as defined in claim 1, wherein:

(a) said door has pairs of contacts comprising a power circuit, one contact pair being connected to a supply side of the power circuit and the other pair being connected to the consumption side of the power circuit.

6. The invention as defined in claim 1, wherein:

(a) said disabling means comprises a current-sensing circuit which includes a resistor and a transistor, (b) said power means comprising a pulse generator, and (c) a latching circuit comprising transistors which supply the pulse generator with power, and rendered inoperable when the current through the current-sensing circuit exceeds a predetermined value.

7. The invention as defined in claim 6, and further including:

(a) a time delay capacitor connected to the transistor to minimize the possibility of the latter responding to transients.

8. The invention as defined in claim 6, wherein:

(a) substantially all of the current flowing through the electrically powered mechanism of the door flows through the resistor of the current sensing circuit.

9. The invention as defined in claim 6, wherein:

(a) said latching circuit comprises a pair of transistors, each transistor having a base and an emitter, (b) means interconnecting said transistors to bias the same for simultaneous "on" conditions, (c) each of said transistors having a biasing resistor connected between its base and emitter, and (d) each of said transistors having a filter capacitor connected between its base and emitter to prevent inadvertent latching of the transistors under the action of transients or spikes.

10. The invention as defined in claim 2, wherein:

(a) said pulse generator has a positive supply terminal connected to the positive side of the vehicle battery, and (b) a latching circuit connected to the negative supply of said pulse generator, (c) said latching circuit effecting electrical connection of the negative supply terminal of the pulse generator to a point of electrical potential which is distinct from that to which the positive supply terminal is connected.

11. The invention as defined in claim 6, wherein:

(a) said latching circuit is triggered by a momentary voltage received from said manually operable member, and (b) an isolation diode connected with said pulse generator to prevent transients in the vehicle electrical system from causing operation of the latching circuit.

12. The invention as defined in claim 10, and further including:

(a) a Zener diode having its cathode connected to the positive side of said power means and its anode connected to a biasing resistor extending to the negative side of the power means, said diode preventing excessive voltages from being applied to said pulse generator.

13. The invention as defined in claim 1, wherein:

(a) said power means comprises a pulse generator, (b) a driver transistor connected to the output of the pulse generator, and (c) a relay adapted to be energized from the pulse generator, (d) said relay having contacts connected in series with one of the electrical contacts on the vehicle body so that when the relay operates, intermittent voltages are applied to the said vehicle body contact.

14. The invention as defined in claim 1, wherein:

(a) said power means comprises a pulse generator having a duty cycle on the order of less than 15%.

15. The invention as defined in claim 1, wherein:

(a) said disabling means substantially completely cuts off current flow to the power means following locking of the door, thereby to prevent drain on the vehicle electrical system following such locking.

16. The invention as defined in claim 1, wherein:

(a) said manually operable locking member comprises the lock-unlock button in the driver compartment of the vehicle.

17. The invention as defined in claim 13, and further including:

(a) a Zener diode connected in circuit with said transistor, in order to suppress electrical transients associated with inductive voltages generated in the coil of the relay and thereby prevent inadvertent damage to said transistor.

18. An electric-powered door lock system for automobiles which have a driver-compartment door equipped with an electric latch and a second door equipped with a locking bolt, comprising in combination:

(a) means including said locking bolt and including an electric-powered actuator and power line for the same, for locking the second door in its closed position in response to energization of said power line, (b) means including said latch and including a current-powered actuator and an additional power line, for locking said driver-compartment door in response to energization of said current-powered actuator, (c) power means responsive to energization of said additional power line, providing intermittent electric power surges in said first-mentioned power line, (d) means for connecting said first-mentioned power line to said electric-powered actuator only when the second door is moved to its closed position, to enable said power surges to activate the electric-powered actuator and lock said second door, and (e) automatically actuated means responsive to current flow in said first-mentioned power line, for automatically rendering inoperative said power means only after sufficient current has flowed in said first-mentioned power line to the electric-powered actuator in order to operate the same.

19. An electric-powered door lock system for a door movable between open and closed positions in a van or other vehicle, comprising in combination:

(a) locking means on the vehicle body and door, to enable the latter to be locked in its closed position, (b) an electrically-powered mechanism carried by said door for operating the locking means, (c) means for effecting electrical connection from the body of the vehicle to the electrically powered mechanism, (d) pulsing means for applying, through said electrical connection effecting means, an intermittent voltage to said electrically-powered mechanism, said pulsing means being capable of powering said electrically-powered mechanism and being rendered operable only in response to closing of said door, and (e) automatically actuated disabling means controlling said pulsing means, for automatically rendering inactive said pulsing means only after said electrically-powered mechanism has been activated at least once, to lock the door.

20. The method of locking the door of an automotive vehicle after the door has been first closed, said door being of the type having an electric actuator which operates a lock mechanism, and having an electrical contact which, when the door is closed, is engageable with a cooperable contact on the vehicle body, said method comprising the steps of:

(a) manually activating an electric triggering circuit which supplies intermittent voltages and remains active to supply said intermittent voltages as long as the door remains open, (b) applying the said intermittent voltages supplied by the triggering circuit to said vehicle body contact, (c) shifting the door to its closed position to effect engagement of the said contacts whereby the intermittent voltages on the contact of the vehicle body are transferred to the contact of the door, only after the door has been closed, to enable said voltages to cause operating current to flow through the electric actuator thereof, and (d) automatically disabling the electric triggering circuit and thereby reducing said operating current only after the door has been locked by the electric actuator.

21. The method of claim 20, wherein:
(a) the disabling of the triggering circuit comprises the step of sensing the operating current that flows through the electric actuator.

22. The invention as defined in claim 18, wherein:
(a) said latch-including means is effective to both lock and unlock said driver-compartment door in response to energization of said current-powered actuator,
(b) the power surges of said power means comprising voltages manifested at said first-mentioned power line,
(c) said voltages causing current flow through said electric-powered actuator to activate the latter,
(d) said first-mentioned power line being substantially devoid of current flow therein when the door is in its open position,
(e) said power means comprising a solid-state timer,
(f) said means for rendering inoperative said power means comprising coupled transistors.

23. The invention as defined in claim 22, wherein:
(a) said means for rendering inoperative said power means comprises a low-ohmage resistor, and a current-sensing transistor connected thereto, for effecting a control over said coupled transistors.

24. The invention as defined in claim 23, wherein:
(a) said power means includes a switching transistor and a relay having its coil connected to said switching transistor and having a contact connected with said coupled transistors.

25. An electric-powered door lock system for a vehicle having an electrical system capable of supplying power, and having a first door and a second door, comprising in combination:
(a) a manually operable locking member,
(b) a first powered locking mechanism associated with the first door,
(c) means responsive to operation of said manually operable locking member, and connected to actuate said powered locking mechanism for locking the said first door when the locking member is operated,
(d) a second powered locking mechanism associated with the second door, for locking the same,
(e) a signal generator connected to draw power from the electrical system of the vehicle, for generating spaced-apart power surges following said operation of the manually operable locking member, and
(f) electrical means responsive to closing of the second door, for coupling said power surges to the second powered mechanism only after said second door has been closed and for automatically interrupting the transmission of power surges to the second powered mechanism following the reception, by said second powered mechanism, of at least one power surge sufficient to operate the second powered mechanism at least once, whereby the power supplied to the signal generator from the vehicle electrical system is conserved as a result of said interrupting.

* * * * *